US006206010B1

(12) United States Patent
Malki

(10) Patent No.: US 6,206,010 B1
(45) Date of Patent: Mar. 27, 2001

(54) CREDIT CARD SHAPED GROOMING DEVICE

(76) Inventor: Abdo Malki, 1005 Pepper Hill Rd., Pasadena, CA (US) 91107

( * ) Notice: Subject to any disclaimer, the term of this patent is extended or adjusted under 35 U.S.C. 154(b) by 0 days.

(21) Appl. No.: 09/544,239

(22) Filed: Apr. 7, 2000

(51) Int. Cl.[7] ..... A45D 24/00
(52) U.S. Cl. ..... 132/161; 132/219; 132/102
(58) Field of Search ..... 132/161, 102, 132/104, 109, 137, 219

(56) References Cited

U.S. PATENT DOCUMENTS

| | | | | |
|---|---|---|---|---|
| D. 53,260 | * | 4/1919 | Von Tobel | 132/104 |
| D. 297,176 | | 8/1988 | Tsai . | |
| 940,532 | | 11/1909 | Jacobs . | |
| 1,258,179 | * | 3/1918 | Bovee | 132/104 |
| 1,530,070 | * | 3/1925 | Bovee | 132/104 |
| 1,731,287 | * | 10/1929 | Barnowitz | 132/102 |
| 2,168,804 | * | 8/1939 | Payson | 132/104 |
| 2,227,451 | * | 1/1941 | Huppert | 132/161 |
| 2,479,142 | | 8/1949 | Taylor . | |
| 3,750,680 | * | 8/1973 | Miller | 132/161 |
| 4,513,842 | | 4/1985 | Karlsberg . | |
| 4,914,129 | * | 4/1990 | Olson | 132/161 |
| 5,231,999 | * | 8/1993 | Schroettner | 132/137 |
| 5,520,202 | | 5/1996 | Arbree . | |

* cited by examiner

*Primary Examiner*—John J. Wilson
*Assistant Examiner*—Robyn Kieu Doan
(74) *Attorney, Agent, or Firm*—Jack Lo

(57) ABSTRACT

The present grooming device is comprised of a flexible sheet generally in the size and shape of a credit card for being carried in a pocket or wallet. The sheet is formed into a comb, a mirror, a nail file, and a nail pick. The comb includes staggered teeth of two different lengths for combing through dry or wet hair equally well. The mirror is a metal foil applied to one side of the sheet. The nail file is an abrasive material applied along a strip on one side of the sheet. The nail pick is claw shaped, and is positioned at a corner of the sheet for being easily maneuvered around nails. A magnetic strip is arranged on an opposite side of the sheet for operating an electronic card reader. Graphics, such as advertising or other information, are displayed on the back of the sheet near the magnetic strip.

10 Claims, 5 Drawing Sheets

CREDIT CARD SHAPED GROOMING DEVICE

BACKGROUND OF THE INVENTION

1. Field of the Invention

This invention relates generally to grooming devices.

2. Prior Art

Various compact combs and grooming devices are known in the prior art for being carried in a purse or a pocket. U.S. Pat. No. 5,520,202 to Arbree discloses a makeup kit with a hinged cover locked by a pair of tabs. A comb is attached to a rear edge of the kit. It is relatively thick and bulky for being carried in pocket. U.S. Pat. No. 4,513,842 to Karlsberg discloses a comb in the size and shape of a credit card. Depressed rectangular areas on opposite sides of the comb provide gripping areas for removing it from a wallet. U.S. Pat. No. 2,479,142 to Taylor discloses a folding comb hinged to fold in half along the plane of the comb. U.S. Pat. No. 940,532 to Jacobs discloses a comb with a mirror on its spine for checking the user's appearance. U.S. Pat. No. Des. 297,176 to Tsai discloses a comb with a removable sheath.

Prior art combs are limited to only combing hair or applying makeup. They cannot perform other grooming functions. Further, they each have teeth of the same length. If the teeth are spaced closely for dry hair, they are too close for wet hair and might snag. If the teeth are spaced for wet hair, they are too far apart for evenly combing dry hair. Although the credit card comb is small enough to fit into a wallet, it cannot actually function as a data card.

OBJECTIVES OF THE INVENTION

Accordingly, the objectives of the present credit card shaped grooming device are:

- to provide a comb for combing hair;
- to be able to comb through dry or wet hair equally well;
- to provide a mirror for allowing a user to check his or her own appearance;
- to provide a file for filing fingernails;
- to provide a pick for cleaning under fingernails;
- to provide a magnetic strip for operating an electronic card reader;
- to display graphics, such as advertising or other information; and
- to be compact enough to fit into a credit card pocket in a wallet.

Further objectives of the present invention will become apparent from a consideration of the drawings and ensuing description.

BRIEF SUMMARY OF THE INVENTION

The present grooming device is comprised of a flexible sheet generally in the size and shape of a credit card for being carried in a pocket or wallet. The sheet is formed into a comb, a mirror, a nail file, and a nail pick. The comb includes staggered teeth of two different lengths for combing through dry or wet hair equally well. The mirror is a thin reflective foil applied to one side of the sheet. The nail file is an abrasive material applied along a strip on one side of the sheet. The nail pick is claw shaped, and is positioned at a corner of the sheet for being easily maneuvered around nails. A magnetic strip is arranged on an opposite side of the sheet for operating an electronic card reader. Graphics, such as advertising or other information, are displayed on the sheet.

DETAILED DESCRIPTION OF THE INVENTION

Figure 1:
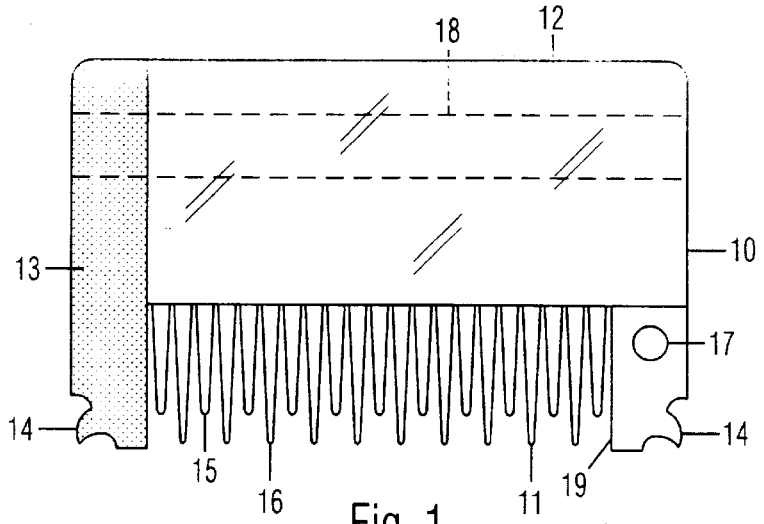
FIG. 1 is a front view of a first embodiment of the present grooming device.

FIG. 1:

A first embodiment of the present grooming device is shown in a front view in FIG. 1. It is comprised of a flexible sheet 10 generally in the size and shape of a credit card for being carried in a pocket or wallet. Sheet 10 is formed into a comb 11 for combing hair, a mirror 12 for checking appearance, a nail file 13 for filing fingernails, and nail picks 14 for cleaning under fingernails. Comb 11 is arranged within a cutout 19 on sheet 10. Comb 11 includes staggered teeth 15 and 16 of two different lengths. Inserting comb 11 partially into the hair makes use of only the widely spaced longer teeth 16 for combing wet hair to prevent snagging. Inserting comb 11 fully into the hair makes use of both shorter teeth 15 and longer teeth 16 for finely combing dry hair to a finished appearance. Comb 11 thus combs through dry or wet hair equally well. Mirror 12 is preferably a reflective foil applied to a first side of sheet 10. Nail file 13 is preferably an abrasive material applied along an elongated strip on the first side of sheet 10. Nail pick 14 is preferably claw shaped, and is positioned at a corner of sheet 10 for being easily maneuvered around fingernails. A hole 17 is provided on sheet 10 for being connected to a key chain. A magnetic strip 18 is arranged on an opposite second side of sheet 10 for operating a card reader, such as an electronic door lock on a hotel room. Graphics, such as advertising or other information, are displayed on the back of the sheet near the magnetic strip.

In this example, comb 11 is arranged along one of the longitudinal edges of sheet 10. Mirror 12 is arranged along the opposite longitudinal edge of sheet 10. Nail file 13 is arranged along a transverse edge of sheet 10. Two nail picks 14 are provided at the corners of sheet 10 on opposite sides of comb 11. Hole 17 is arranged to one side of comb 11.

Figure 2:
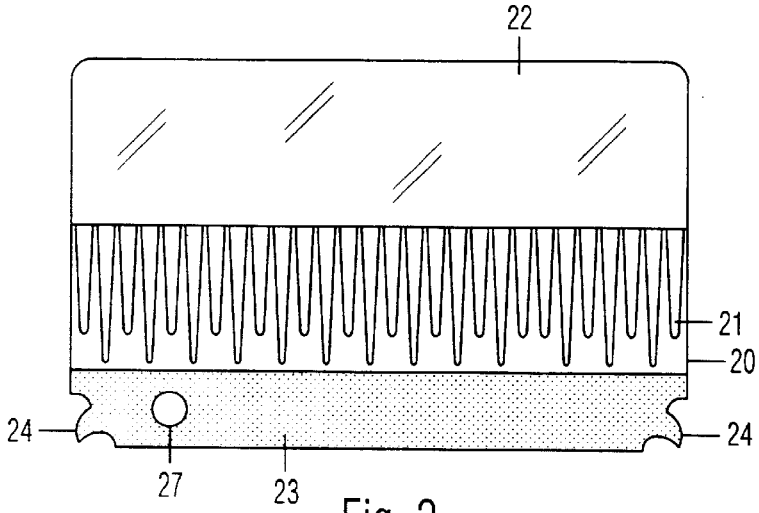
FIG. 2 is a front view of a second embodiment thereof.
Figure 3:
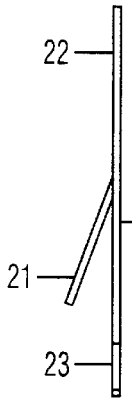
FIG. 3 is a side view of the grooming device of FIG. 2 in one embodiment.
Figure 4:
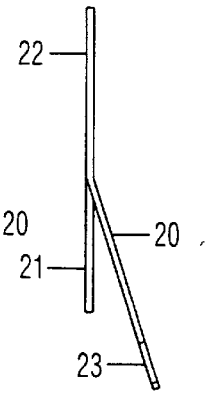
FIG. 4 is a side view of the grooming device of FIG. 2 in another embodiment.

FIGS. 2–4:

A second embodiment of the grooming device is shown in a front view in FIG. 2. Nail file 23 is positioned along a longitudinal edge of sheet 20. Mirror 22 is positioned along an opposite longitudinal edge of sheet 20. Comb 21 is positioned between nail file 23 and mirror 22. Nail picks 24 are at opposite ends of nail file 23. A hole 27 is provided on file 23 for being carried on a key chain. The magnetic strip (not shown) is positioned on the opposite side of sheet 20. Graphics, such as advertising or other information, are displayed on the back of the sheet near the magnetic strip. In one embodiment shown in a side view in FIG. 3, the teeth of comb 21 are angled away from mirror 22 and file 23. In another embodiment shown in a side view in FIG. 4, the teeth of comb 21 are coplanar with mirror 22, and nail file 23 is angled away from comb 21.

Figure 5:
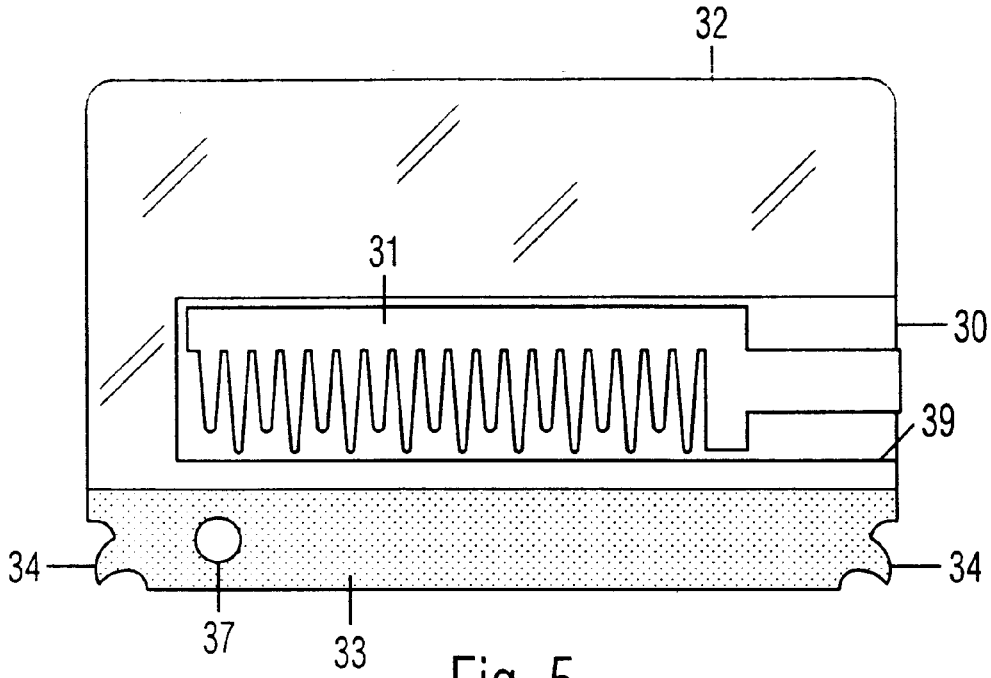
FIG. 5 is a front view of a third embodiment thereof.
Figure 6:
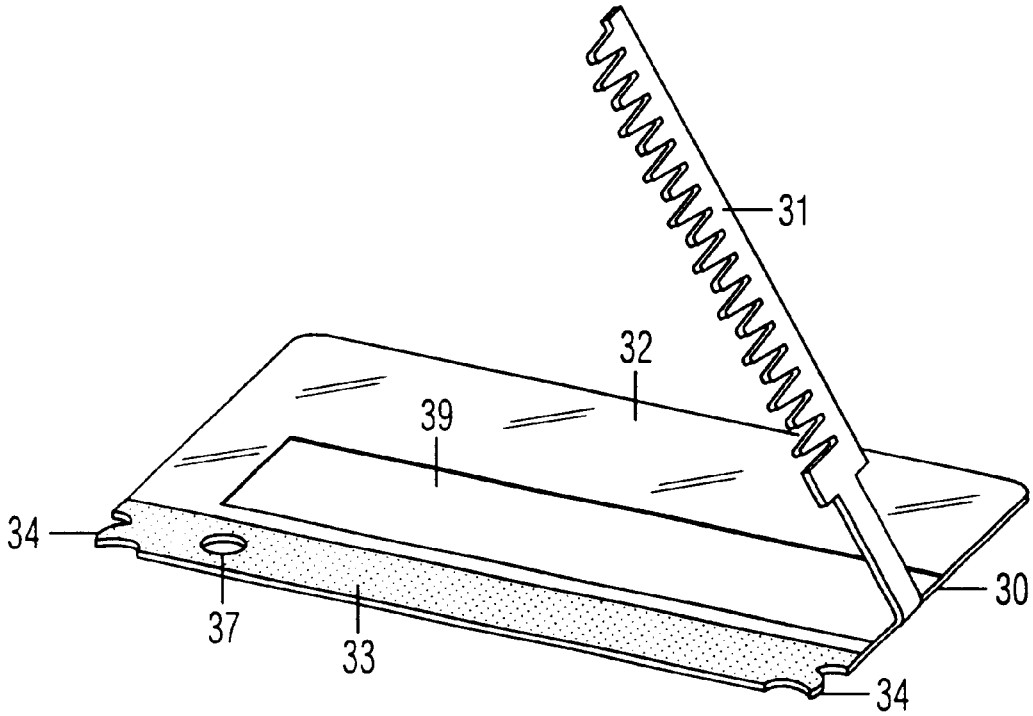
FIG. 6 is a front perspective view of the grooming device of FIG. 5 with a comb being unfolded.

FIGS. 5–6:

A third embodiment of the grooming device is shown in a front view in FIG. 5. Nail file 33 is positioned along a longitudinal edge of sheet 30. Mirror 32 is positioned along an opposite longitudinal edge of sheet 30. Comb 31 is arranged within a recess 39 in mirror 32. One end of comb 31 is hinged, preferably by a living hinge, to a transverse edge of sheet 30. Comb 31 is folded in recess 39 when not in use, and unfolded for use. Nail picks 34 are at opposite ends of nail file 33. A hole 37 is provided on nail file 33 for being connected to a key chain. Comb 31 is shown being unfolded in FIG. 6. The magnetic strip (not shown) is positioned on the opposite side of sheet 30. Graphics, such as advertising or other information, are displayed on the back of the sheet near the magnetic strip.

Figure 7:
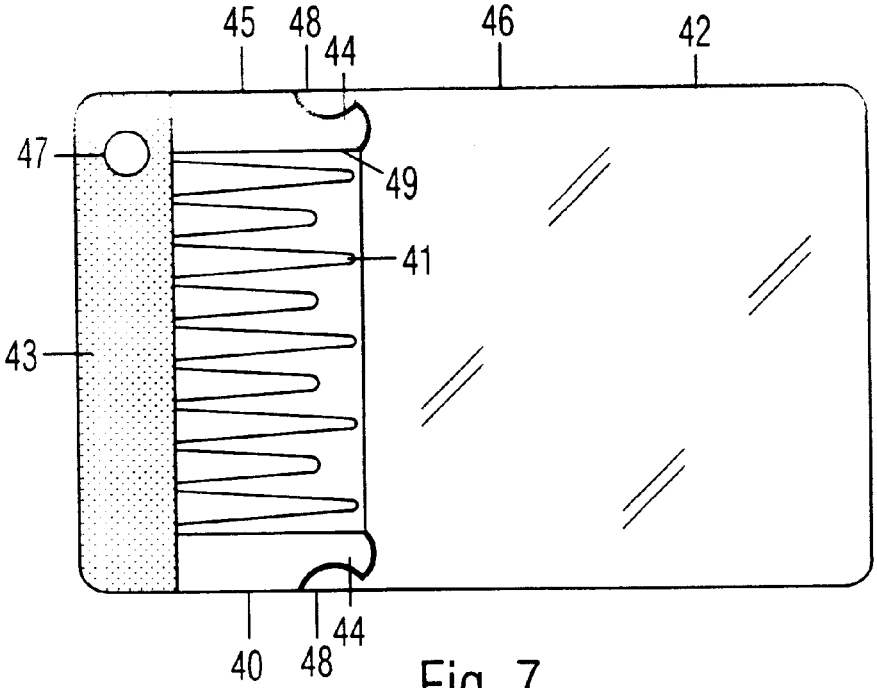
FIG. 7 is a front view of a fourth embodiment thereof.
Figure 8:
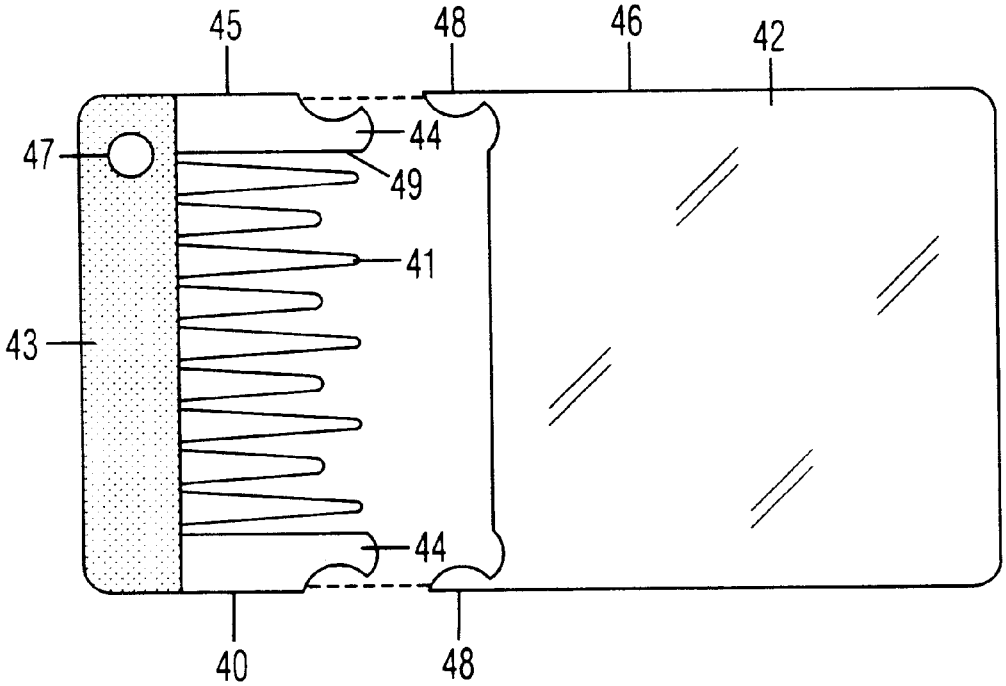
FIG. 8 is a front view of the grooming device of FIG. 7 with two portions detached from each other.

FIGS. 7–8:

A fourth embodiment of the grooming device is shown in a front view in FIG. 7. Sheet 40 is separable into a first portion 45 and a second portion 46. Nail file 43 is positioned along a transverse edge of portion 45. Mirror 42 is arranged on second portion 46. Comb 41 is arranged within a cutout 49 along an inside edge of first portion 45. Nail picks 44 are at opposite ends of comb 41 on respective longitudinal edges of sheet 40. A hole 47 is provided on nail file 43 for being connected to a key chain. A pair of locking tabs 48 extend from respective longitudinal edges of second portion 46. As shown in FIG. 8, locking tabs 48 mate with nail picks 44 and detachably lock first portion 45 and second portion 46 together. The magnetic strip (not shown) is positioned on the opposite side of sheet 46. Graphics, such as advertising or other information, are displayed on the back of the sheet near the magnetic strip.

Figure 9:
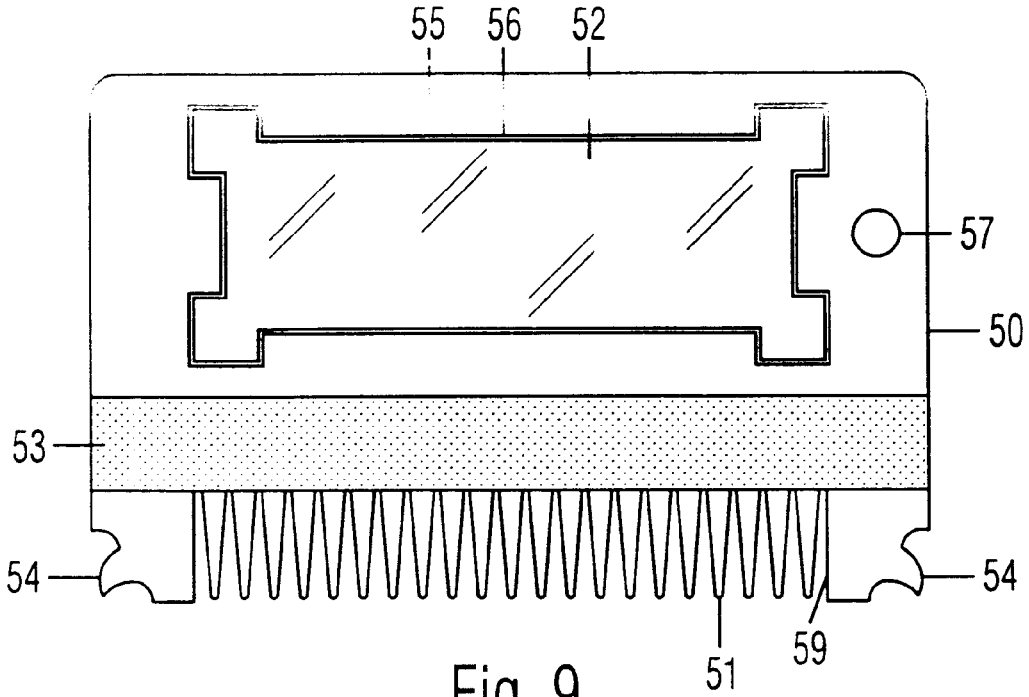
FIG. 9 is a front view of a fifth embodiment thereof

FIG.9:

A fifth embodiment of the grooming device is shown in a front view in FIG. 9. Comb 51 is arranged in a cutout 59 along a longitudinal edge of sheet 50. In this example, comb 51 has teeth of the same length. Nail picks 54 are at opposite ends of comb 51. Mirror 52 is detachably positioned within a recess 56 on sheet 50, preferably by snap fit. Nail file 53 is arranged between comb 51 and mirror 52. A printed area 55 is arranged along a back of sheet 50 behind mirror 52 for displaying advertising or other information. A hole 57 is provided on printed area 55 for being connected to a key chain. The magnetic strip (not shown) is positioned on the opposite side of sheet 50.

Figure 10:
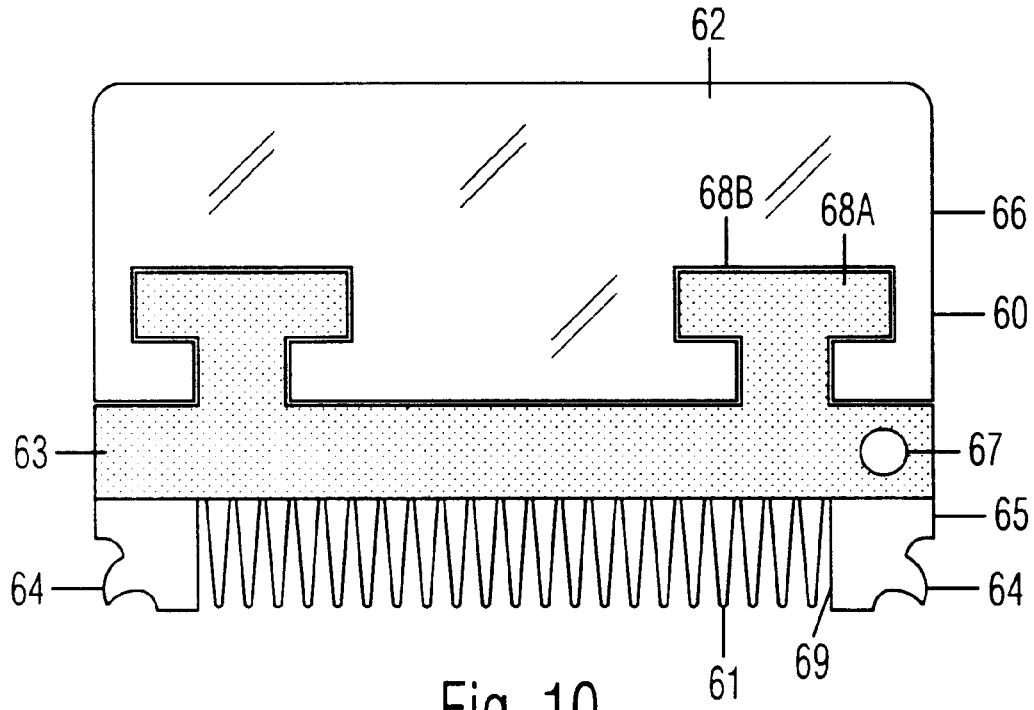
FIG. 10 is a front view of a sixth embodiment thereof.

FIG. 10:

A sixth embodiment of the grooming device is shown in a front view in FIG. 10. Sheet 60 is separable into a first portion 65 and a second portion 66 connected by locking tabs 68A extending from first portion 65 and mating notches 68B in second portion 66. Comb 61 is arranged within a cutout 69 on a longitudinal edge of sheet 60 on first portion 65. Mirror 62 is arranged along an opposite longitudinal edge of sheet 60 on second portion 66. Nail file 63 is arranged along an inside edge of first portion 65. Nail picks 64 are at opposite ends of comb 61.

A hole 67 is provided on nail file 63 for being connected to a key chain. The magnetic strip (not shown) is positioned on the opposite side of sheet 60. Graphics, such as advertising or other information, are displayed on the back of the sheet near the magnetic strip.

Figure 11:
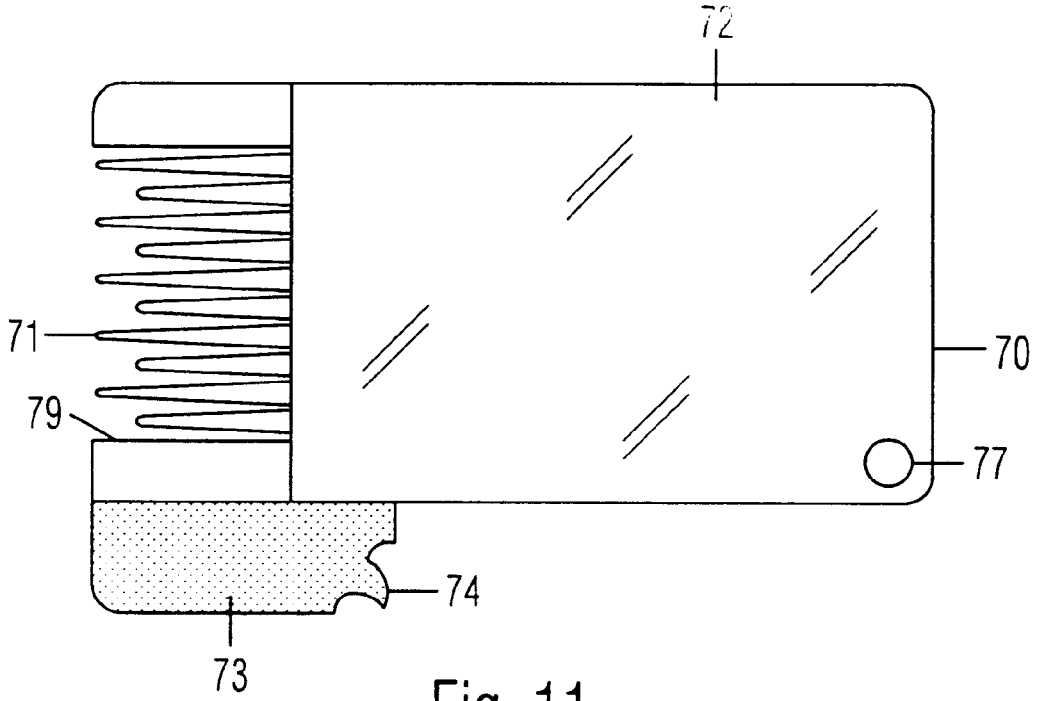
FIG. 11 is a front view of a seventh embodiment thereof.

FIG. 11:

A seventh embodiment of the grooming device is shown in a front view in FIG. 11. Comb 71 is arranged on a transverse edge of sheet 70 in a cutout 79. A mirror 72 is arranged along an opposite transverse edge of sheet 70. A nail file 73 projects outwardly from a longitudinal edge of sheet 70, and extends only partially along sheet 70. When sheet 70 is inserted into an electronic card reader, nail file 73 acts as a stop to prevent sheet 70 from being inserted too far. A nail pick 74 is arranged on a comer of nail file 73. A hole 77 is provided on mirror 72 for being connected to a key chain. The magnetic strip (not shown) is positioned on the opposite side of sheet 70. Graphics, such as advertising or other information, are displayed on the back of the sheet near the magnetic strip.

Figure 12:
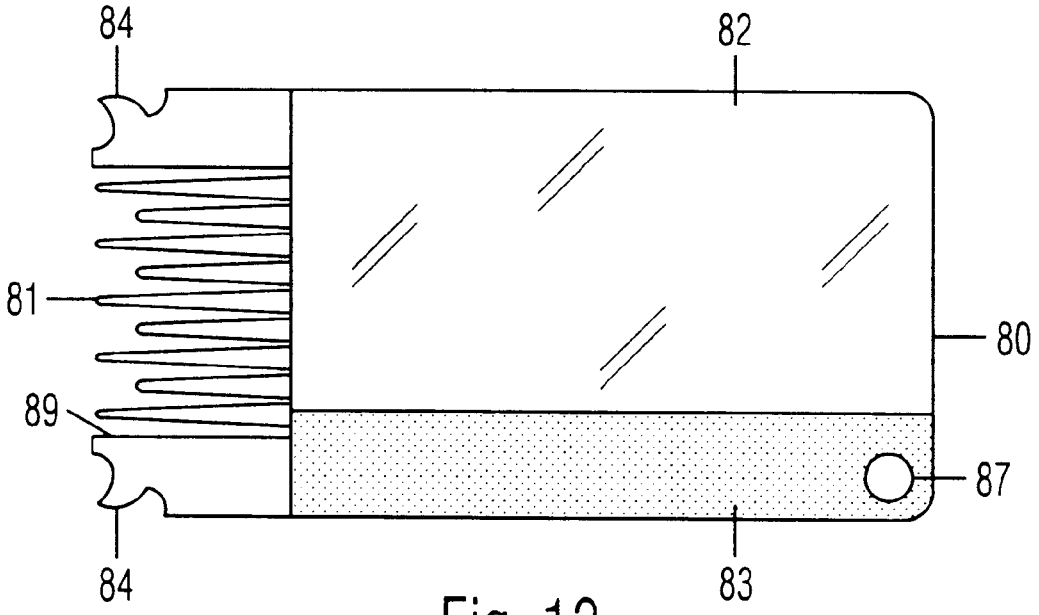
FIG. 12 is a front view of an eighth embodiment thereof.

FIG. 12:

An eighth embodiment of the grooming device is shown in a front view in FIG. 12. Comb 81 is arranged on a transverse edge of sheet 80 in a cutout 89. A mirror 82 is arranged along an opposite transverse edge of sheet 80. A nail file 83 extends along a longitudinal edge of sheet 80. Nail picks 84 are arranged at two comers of sheet 80 at opposite ends of comb 81. A hole 87 is provided on nail file 83 for being connected to a key chain. The magnetic strip (not shown) is positioned on the opposite side of sheet 80. Graphics, such as advertising or other information, are displayed on the back of the sheet near the magnetic strip.

SUMMARY AND SCOPE

Accordingly, the present grooming device provides a comb for combing hair. It is able to comb through dry or wet hair equally well. It provides a mirror for allowing a user to check his or her appearance. It provides a file for filing fingernails. It provides a pick for cleaning under fingernails. It provides a magnetic strip for operating an electronic card reader. It is compact enough to fit into a credit card pocket in a wallet or on a key chain. It displays graphics, such as advertising or other information.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not only by the examples given.

I clam:

1. A grooming device, comprising:

a rectangular sheet generally of a size and shape similar to a credit card for being carried in a wallet;

a comb arranged on said sheet, wherein said comb includes a plurality of staggered teeth including longer teeth and shorter teeth, said comb is adapted to be partially inserted into a person's hair to use only said longer teeth, that is, about half of said staggered teeth, for combing wet hair to prevent snagging, and said comb is adapted to be fully inserted into said hair to use said longer teeth and shorter teeth, that is, about all of said staggered teeth, for finely combing dry hair to a finished appearance;

a mirror attached to a front side of said sheet, said mirror comprising a reflective foil for thinness, lightweight, and economy;

a nail file comprising an abrasive material applied along an elongated strip on said sheet for filing fingernails;

a generally claw-shaped nail pick positioned at a comer of said sheet for being easily maneuvered around said fingernails; and a magnetic strip on said sheet for operating a card reader.

2. The grooming device of claim 1, wherein said comb is arranged within a cutout along a longitudinal edge of said sheet to maximize length of said comb, said mirror is arranged along an opposite longitudinal edge of said sheet to maximize length of said mirror, and said nail file is arranged along a transverse edge of said sheet to provide more space to said comb and said mirror.

3. The grooming device of claim 1, wherein said nail file is arranged along a longitudinal edge of said sheet to maximize length of said nail file, said mirror is arranged along an a opposite longitudinal edge of said sheet to maximize length of said mirror, and said comb is arranged a t an intermediate position on said sheet between said mirror and said nail file, said comb is connected to said sheet along a longitudinal edge of said comb and angled outwardly from said sheet.

4. The grooming device of claim 1, wherein said nail file is arranged along a longitudinal edge of said sheet to maximize length of said nail file, said mirror is arranged along an opposite longitudinal edge of said sheet to maximize length of said mirror, and said comb is arranged at an intermediate position on said sheet between said mirror and said nail file, one end of said comb is hinged to a transverse edge of said sheet, said comb is positioned against said sheet when not in use, said comb is pivoted outwardly for use.

5. The grooming device of claim 1, wherein said sheet is separable into a first portion and a second portion along a transverse joint, said nail file is positioned along an outer edge of said first portion, said mirror is arranged on said second portion, said comb is arranged within a cutout along an inner edge of said first portion, said nail pick is arranged at a first corner of said inside edge of said first portion; and further including a second nail pick arranged at a second corner of said inside edge of said first portion; and further a pair of locking tabs extending from an inside edge of said second portion, said locking tabs mating with said nail picks on said first portion and detachably locking said first portion and said second portion together.

6. The grooming device of claim 1, wherein said comb is arranged in a cutout along a longitudinal edge of said sheet, said mirror is detachably positioned within a recess on said sheet adjacent an opposite longitudinal edge of said sheet, and said nail file is arranged between said comb and said mirror.

7. The grooming device of claim 1, wherein said sheet is separable into a first portion and a second portion along a longitudinal joint, said comb is arranged along an outer edge of said first portion, said mirror is arranged on said second portion;

further including a plurality of locking tabs extending from an inner edge of said first portion, said locking tabs mating with a plurality of mating notches on an inner edge of said second portion and detachably locking said first portion and said second portion together.

8. The grooming device of claim 1, wherein said comb is arranged on a transverse edge of sheet, said mirror is arranged along an opposite transverse edge of said sheet, said nail file is projecting outwardly from a longitudinal edge of said sheet and extending only partially along said longitudinal edge, so that when sheet is inserted into said card reader, said sheet is prevented by said nail file from being inserted too far.

9. The grooming device of claim 1, wherein said comb is arranged within a cutout along a transverse edge of said sheet, said mirror is arranged along an opposite transverse edge of said sheet, said nail file is arranged along a longitudinal edge of said sheet.

10. A grooming device, comprising:

a sheet generally of a size and shape similar to a credit card for being carried in a wallet;

a comb arranged on said sheet, wherein said comb includes a plurality of staggered teeth including longer teeth and shorter teeth, said comb is adapted to be partially inserted into a person's hair to use only said longer teeth, that is, about half of said staggered teeth, for combing wet hair to prevent snagging, and said comb is adapted to be fully inserted into said hair to use said longer teeth and shorter teeth, that is, about all of said staggered teeth, for finely combing dry hair to a finished appearance;

a mirror attached to a front side of said sheet, said mirror comprising a reflective foil for thinness, lightweight, and economy;

a nail file comprising an abrasive material applied along an elongated strip on said sheet for filing fingernails;

a claw-shaped nail pick positioned at a corner of said sheet for being easily maneuvered around said fingernails;

a magnetic strip on said sheet for operating a card reader;

a hole on said sheet for being connected to a key chain; and graphics displayed on a back of said sheet.

* * * * *